US009640890B2

(12) United States Patent
Ito

(10) Patent No.: US 9,640,890 B2
(45) Date of Patent: May 2, 2017

(54) TERMINAL AND TERMINAL CONNECTION STRUCTURE

(71) Applicant: YAZAKI CORPORATION, Tokyo (JP)

(72) Inventor: Yoshitaka Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/181,549

(22) Filed: Jun. 14, 2016

(65) Prior Publication Data

US 2016/0372852 A1 Dec. 22, 2016

(30) Foreign Application Priority Data

Jun. 19, 2015 (JP) ..... 2015-123444

(51) Int. Cl.
*H01R 13/11* (2006.01)

(52) U.S. Cl.
CPC ..... *H01R 13/111* (2013.01)

(58) Field of Classification Search
CPC ..... H01R 13/111; H01R 13/11
USPC ..... 439/851–854
See application file for complete search history.

(56) References Cited

U.S. PATENT DOCUMENTS 4,293,181 A * 10/1981 Lacaze, Jr. ..... H01R 13/111 439/851
5,554,056 A * 9/1996 Henricus op ten Berg ..... H01R 13/112 439/851
5,857,879 A * 1/1999 Endo ..... H01R 43/16 439/843
6,547,608 B2 * 4/2003 Sato ..... H01R 13/11 439/851
8,821,196 B2 * 9/2014 Blasick ..... H01R 13/111 439/851
2009/0191768 A1 * 7/2009 Shimizu ..... H01R 13/04 439/816

FOREIGN PATENT DOCUMENTS

JP 2014-053119 A 3/2014

* cited by examiner

*Primary Examiner* — Gary Paumen
(74) *Attorney, Agent, or Firm* — Mots Law, PLLC

(57) ABSTRACT

There are provided: a female terminal having a cylindrical base portion and a plurality of elastic contact pieces protruding from a plurality of locations of the base portion in a circumferential direction and being elastically deformable; and a male terminal having a tab portion whose outer peripheral surface is formed as a circumferential surface, a radius of curvature of an inner surface of each of the elastic contact pieces is formed larger than a radius of the tab portion, and when the tab portion is inserted into an insertion space surrounded by the plurality of elastic contact pieces, each of the elastic contact pieces is elastically deformed to an outer side, and the tab portion and each of the elastic contact pieces come into contact with each other.

4 Claims, 3 Drawing Sheets

TERMINAL AND TERMINAL CONNECTION STRUCTURE

CROSS REFERENCE TO RELATED APPLICATIONS

The present application claims priority of Japanese Patent Application No. 2015-123444 filed on Jun. 19, 2015 and the entire content is incorporated herein by reference.

BACKGROUND

1. Technical Field

The present invention relates to a terminal to which a mating terminal is connected and a terminal connection structure including a female terminal and a male terminal connected to each other.

2. Related Art

FIGS. 3A and 3B illustrate a terminal connection structure illustrated in Patent Literature 1 (Japanese Patent Application Publication No. 2014-53119) as a prior-art example. As illustrated in FIGS. 3A and 3B, the prior-art terminal connection structure has a pair of female terminal 101 and male terminal 110 connected to each other. The male terminal 110 includes a tab portion 112 whose outer peripheral surface 111 is formed as a circumferential surface. The female terminal 101 includes a cylindrical base portion 102, and a plurality of elastically deformable elastic contact pieces 103 protruding from a plurality of locations of the base portion 102 in the circumferential direction. In the female terminal 101, an insertion space 104 surrounded by the plurality of elastic contact pieces 103 is formed. The tab portion 112 of the male terminal 110 is inserted into the insertion space 104. An inner surface 105 of each of the elastic contact pieces 103 and the outer peripheral surface 111 of the tab portion 112 are formed having the same radius of curvature. Here, the respective radiuses of curvature of the inner surface 105 of each of the elastic contact pieces 103 and the outer peripheral surface 111 of the tab portion 112 are defined in a direction along the circumferential direction of the tab portion 112. Each of the elastic contact pieces 103 is extended in parallel with the tab portion 112 from the base portion 102 side toward a tip end and has its tip end side bent in a diameter-expanding direction.

In the above configuration, when the tab portion 112 of the male terminal 110 is inserted into the insertion space 104 from the tip end side of the elastic contact piece 103 of the female terminal 101, each of the elastic contact pieces 103 is elastically deformed to an outer side (diameter-expanding direction), respectively. As a result, insertion of the tab portion 112 into the insertion space 104 is allowed. The inner surface 105 of each of the elastic contact pieces 103 and the outer peripheral surface 111 of the tab portion 112 come into planar contact with each other, by using a deflection restoring force of each of the elastic contact pieces 103 as a contact load. Accordingly, a portion between the female terminal 101 and the male terminal 110 is brought into conduction.

SUMMARY

Incidentally, in the above prior-art terminal connection structure, when the tab portion 112 of the male terminal 110 is inserted into the insertion space 104 of the female terminal 101, the inner surface 105 of each of the elastic contact pieces 103 and the outer peripheral surface 111 of the tab portion 112 come into planar contact and a contact area is increased, and thus there is a problem that adhesion is easily generated between each of the elastic contact pieces 103 and the tab portion 112. Particularly, in a case where silver (Ag) plating is applied to the inner surface 105 of each of the elastic contact pieces 103, the adhesion is more easily generated between each of the elastic contact pieces 103 and the tab portion 112. When adhesion is generated, abrasion powders are generated along with the adhesion, which leads to a problem that abrasion amounts of each of the elastic contact pieces 103 and the tab portion 112 are increased, and abrasion resistance is lowered.

The present invention has been made in view of the above circumstances and an object of the present invention is to provide a terminal and a terminal connection structure which can suppress adhesion generated between each of the elastic contact pieces and the tab portion and can enhance abrasion resistance.

A terminal of the present invention includes: a cylindrical base portion; and a plurality of elastic contact pieces protruding from a plurality of locations of the base portion in a circumferential direction and being elastically deformable, a tab portion of a mating terminal being inserted into an insertion space surrounded by the plurality of elastic contact pieces, the tab portion having a circumferential surface, each of the elastic contact pieces being elastically deformed to an outer side, and each of the elastic contact pieces coming into contact with the tab portion, wherein a radius of curvature of an inner surface of each of the elastic contact pieces is formed larger than a radius of the tab portion.

A terminal connection structure of the present invention includes: a female terminal having a cylindrical base portion and a plurality of elastic contact pieces protruding from a plurality of locations of the base portion in a circumferential direction and being elastically deformable; and a male terminal having a tab portion whose outer peripheral surface is formed as a circumferential surface, the tab portion of the male terminal being inserted into an insertion space surrounded by the plurality of elastic contact pieces, each of the elastic contact pieces being elastically deformed to an outer side, and the tab portion and each of the elastic contact pieces coming into contact with each other, wherein a radius of curvature of an inner surface of each of the elastic contact pieces is formed larger than a radius of the tab portion.

The plurality of elastic contact pieces preferably has inclination portions inclined in a direction of making the insertion space narrower as going from the base portion side toward tip ends.

BRIEF DESCRIPTION OF DRAWINGS

The invention will now be described with reference to the accompanying drawings wherein.

DETAILED DESCRIPTION

An embodiment of the present invention will be described below with reference to the drawings.

Figure 1:
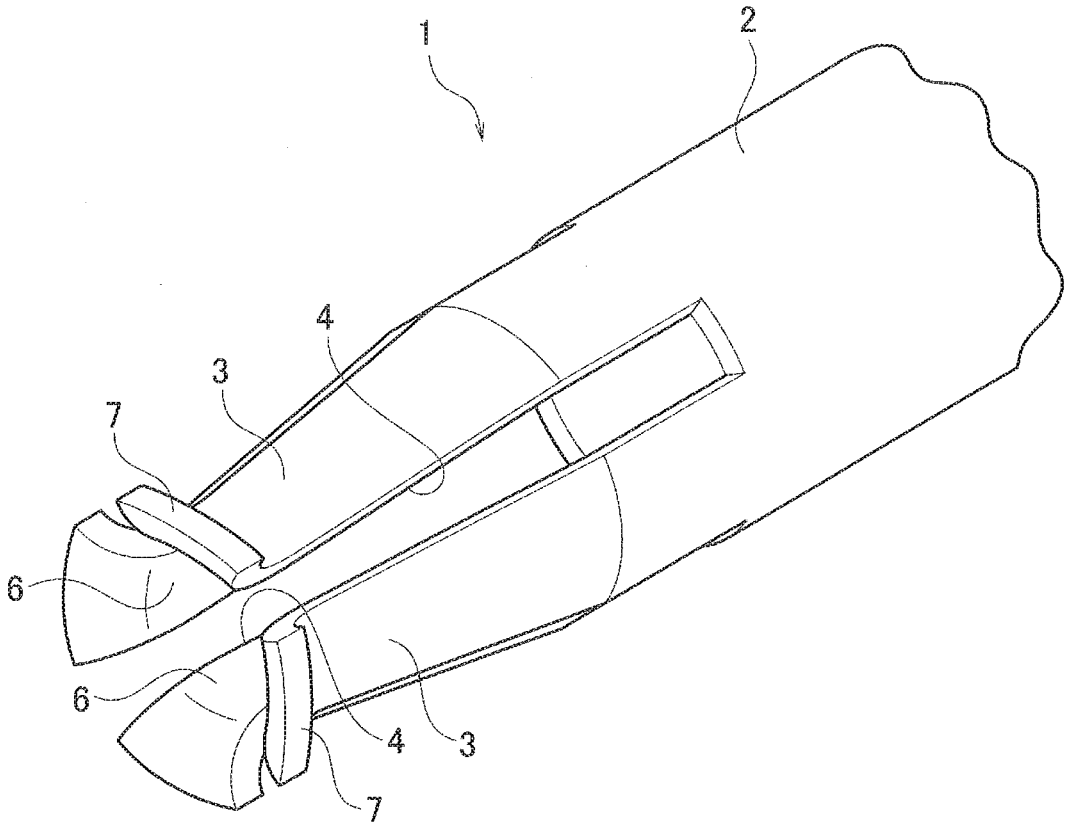
FIG. 1 illustrates an embodiment of the present invention and is a perspective view of an essential part of a female terminal.
Figure 2A:
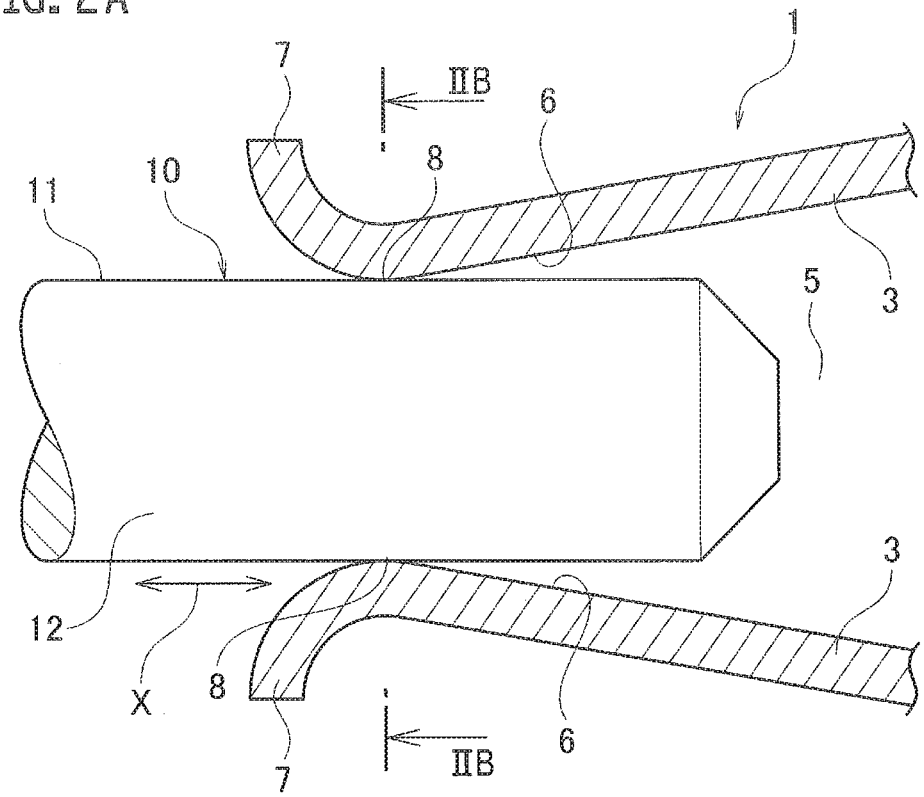
FIG. 2A illustrates the embodiment of the present invention and is a cross-sectional view illustrating a contact state between elastic contact pieces of the female terminal and a tub portion of a male terminal.
Figure 2B:
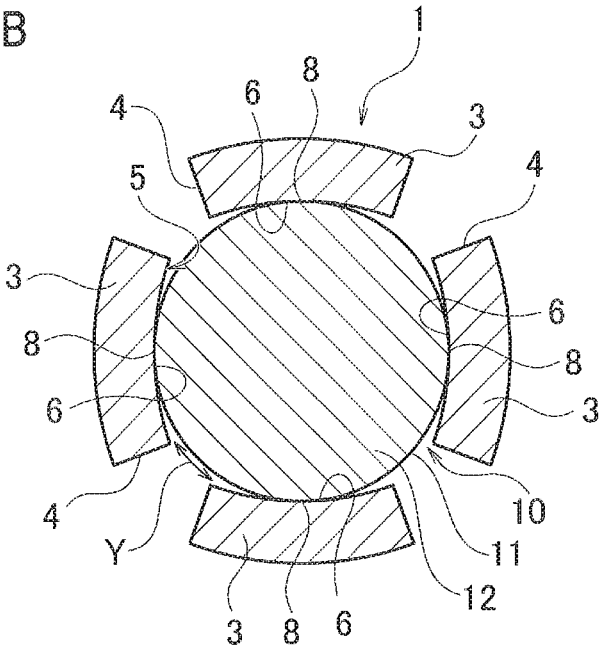
FIG. 2B illustrates the embodiment of the present invention and is a cross-sectional view along a IIB-IIB line in FIG. 2A.
Figure 3A:
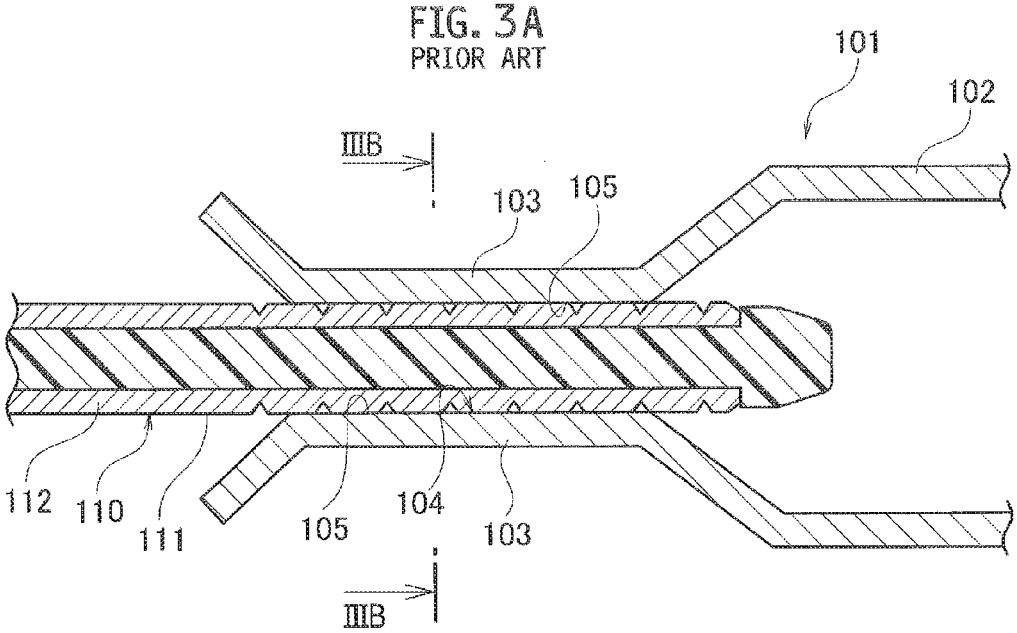
FIG. 3A PRIOR ART
FIG. 3A illustrates a prior-art example and is a cross-sectional view of a terminal connection structure.
Figure 3B:
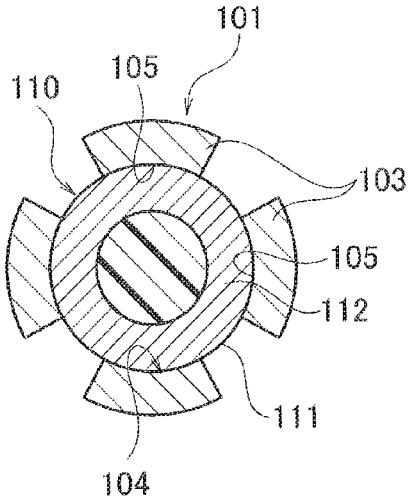
FIG. 3B PRIOR ART
FIG. 3B illustrates the prior-art example and is a cross-sectional view along a IIIB-IIIB line in FIG. 3A.

FIGS. 1, 2A, and 2B illustrate a terminal connection structure according to embodiment of the present invention.

The terminal connection structure has a female terminal 1 (a terminal) and a male terminal 10 (a mating terminal). As illustrated in FIG. 1, the female terminal 1 includes a cylindrical base portion 2, and four elastic contact pieces 3 protruding from a plurality of locations of the base portion 2 in a circumferential direction and elastically deformable. A slit 4 extending in a protruding direction of each of the elastic contact pieces 3 is formed between the adjacent elastic contact pieces 3. All insertion space 5 surrounded by the plurality of elastic contact pieces 3 is formed in the female terminal 1. An electric wire, not shown, is connected to a rear end of the base portion 2.

As illustrated in FIGS. 2A and 2B, the male terminal 10 includes a tab portion 12 having an outer peripheral surface 11 formed as a circumferential surface.

A radius of curvature of an inner surface 6 of each of the elastic contact pieces 3 is formed larger than a radius of the tab portion 12. Here, the radius of curvature of the inner surface 6 of each of the elastic contact pieces 3 is defined on the basis of curvature of the tab portion 12 in a direction along the circumferential direction (direction indicated by an arrow Y in FIG. 2B). Namely, the radius of curvature of the inner surface 6 of each of the elastic contact pieces 3 is defined on a surface orthogonal to an insertion direction or an axial direction of the tab portion 12 (direction indicated by an arrow X in FIG. 2A).

The radius of curvature of the inner surface 6 of each of the elastic contact pieces 3 is formed larger than the radius of the tab portion 12, and thus the inner surface 6 of each of the elastic contact pieces 3 comes into contact with the outer peripheral surface 11 of the tab portion 12 only in a local range in the circumferential direction when the tab portion 12 of the male terminal 10 is inserted into the insertion space 5 of the female terminal 1.

Furthermore, in the vicinity of a tip end 7 of each of the elastic contact pieces 3, a contact portion 8 contacting with the outer peripheral surface 11 of the tab portion 12 is formed. Each of the elastic contact pieces 3 is constituted of an inclination portion which is a portion from a connecting position between the base portion 2 and the elastic contact piece 3 to the contact portion 8 located on the tip end 7 side, and a tip end portion located on a side closer to the tip end 7 side than the contact portion 8. The inclination portion of each of the elastic contact pieces 3 is inclined in a direction of making the insertion space 5 narrower as going toward the tip end 7 from the base portion 2 side. In addition, the tip end portion of each of the elastic contact pieces 3 is curved in a diameter-expanding direction as going toward the tip end 7.

Accordingly, in each of the elastic contact pieces 3, the inner surface 6 of the contact portion 8 formed in the vicinity of the tip end 7 comes into contact with the outer peripheral surface 11 of the tab portion 12 only in the local range in the insertion direction or in the axial direction (direction indicated by the arrow X in FIG. 2A) of the tab portion 12. Therefore, an area in which the contact portion 8 of each of the elastic contact pieces 3 comes into contact with the tab portion 12 becomes smaller than the prior-art case in which each of the elastic contact pieces comes into planar contact with the tab portion, and the contact portion 8 of each of the elastic contact pieces 3 comes into contact with the outer peripheral surface 11 of the tab portion 12, in a point-contact state or in a state close to point contact.

In the above configuration, when the tab portion 12 of the male terminal 10 is inserted into the insertion space 5 of the female terminal 1, the tab portion 12 comes into contact with the tip end portion of each of the elastic contact pieces 3, whereby each of the elastic contact pieces 3 is elastically deformed to an outer side (outer diameter direction), respectively. Therefore, the contact portion 8 of each of the elastic contact pieces 3 comes into contact with the outer peripheral surface 11 of the tab portion 12 by using a deflection restoring force of each of the elastic contact pieces 3 as a contact load, and a portion between the female terminal 1 and the male terminal 10 is brought into conduction.

As described above, since the contact portion 8 of each of the elastic contact pieces 3 comes into point contact in the circumferential direction of the tab portion 12, adhesion becomes difficult to be generated between each of the elastic contact pieces 3 and the tab portion 12. Accordingly, the abrasion powders along with the adhesion are reduced, whereby the abrasion amounts of each of the elastic contact pieces 3 and the tab portion 12 is decreased, abrasion resistance is enhanced, and plating thicknesses of each of the elastic contact pieces 3 and the tab portion 12 can be reduced, and thus a cost required for plating can be reduced.

Furthermore, the plurality of elastic contact pieces 3 is inclined by having the inclination portions in the direction of making the insertion space 5 narrower as going from the base portion 2 side toward the tip ends 7, and thus the contact portion 8 of each of the elastic contact pieces 3 comes into point contact also in the insertion direction or in the axial direction of the tab portion 12, whereby adhesion between each of the elastic contact pieces 3 and the tab portion 12 is less likely to be generated. As a result, abrasion resistance can be further enhanced.

Moreover, as compared with the prior-art case here each of the elastic contact pieces comes into planar contact with the tab portion, the contact area between the contact portion 8 of each of the elastic contact pieces 3 and the tab portion 12 is smaller, and thus sliding resistance between each of the elastic contact pieces 3 and the tab portion 12 is also reduced. Therefore, since insertion or removal of the tab portion 12 of the male terminal 10 can be performed with an operation force smaller than that of the case illustrated in the prior-art example, workability when the female terminal 1 and the male terminal 10 are fitted or separated can also be enhanced.

While embodiments of the present invention have been described hereinabove, these embodiments are merely illustration described for the purpose of facilitating the understanding of the present invention, and the present invention is not limited to the embodiments. The technical scope of the present invention is not limited to the specific technical matters disclosed in the above embodiments, but includes various modifications, changes, alternative techniques and the like which can be readily led therefrom.

INDUSTRIAL APPLICABILITY

According to the present invention, since the radius of curvature of the inner surface of each of the elastic contact pieces is larger than the radius of the tab portion, the area in which the inner surface of each of the elastic contact pieces comes into contact with the outer peripheral surface of the tab portion becomes smaller than the prior-art case in which each of the elastic contact pieces comes into planar contact with the tab portion, and adhesion between each of the elastic contact pieces and the tab portion is less likely to be generated. Accordingly, the abrasion powders along with the adhesion are reduced, whereby the abrasion amounts of each of the elastic contact pieces and the tab portion decrease, and abrasion resistance can be enhanced.

REFERENCE SIGNS LIST

1 female terminal (terminal)
2 base portion
3 elastic contact piece
5 insertion space
6 inner surface
7 tip end
10 male terminal (mating terminal)
11 outer peripheral surface
12 tab portion

What is claimed is:

1. A terminal comprising:

a cylindrical base portion; and a plurality of elastic contact pieces protruding from a plurality of locations of the base portion in a circumferential direction and being elastically deformable, a tab portion of a mating terminal being inserted into an insertion space surrounded by the plurality of elastic contact pieces, the tab portion having a circumferential surface, each of the elastic contact pieces being elastically deformed to an outer side, and each of the elastic contact pieces coming into point contact with the tab portion, wherein a radius of curvature of an inner surface of each of the elastic contact pieces is formed larger than a radius of the tab portion.

2. The terminal according to claim 1, wherein the plurality of elastic contact pieces has inclination portions inclined in a direction of making the insertion space narrower as going from the base portion toward tip ends of the elastic contact pieces.

3. A terminal connection structure comprising:

a female terminal having a cylindrical base portion and a plurality of elastic contact pieces protruding from a plurality of locations of the base portion in a circumferential direction and being elastically deformable; and a male terminal having a tab portion whose outer peripheral surface is formed as a circumferential surface, the tab portion of the male terminal being inserted into an insertion space surrounded by the plurality of elastic contact pieces;

each of the elastic contact pieces being elastically deformed to an outer side, and the tab portion and each of the elastic contact pieces coming into point contact with each other, wherein a radius of curvature of an inner surface of each of the elastic contact pieces is formed larger than a radius of the tab portion.

4. The terminal connection structure according to claim 3, wherein the plurality of elastic contact pieces has inclination portions inclined in a direction of making the insertion space narrower as going from the base portion toward tip ends of the elastic contact pieces.

* * * * *